United States Patent [19]

Kay

[11] 4,269,523

[45] May 26, 1981

[54] PENCILS AND PENCIL CAPS

[76] Inventor: Joel B. Kay, 103 La Fayette, Corlett Dr., Illovo, Johannesburg, Transvaal, South Africa, 2196

[21] Appl. No.: 26,987

[22] Filed: Apr. 4, 1979

[30] Foreign Application Priority Data

Apr. 10, 1978 [ZA] South Africa ..... 78/2018

[51] Int. Cl.[3] ..... B43K 9/00; B43K 29/06

[52] U.S. Cl. ..... 401/51; 401/98

[58] Field of Search ..... 401/50, 51, 98, 243

[56] References Cited

U.S. PATENT DOCUMENTS

| | | | |
|---|---|---|---|
| 1,223,579 | 4/1917 | Grynik | 401/98 |
| 1,887,422 | 11/1932 | Oulton | 401/98 |
| 1,932,486 | 10/1933 | Rohwedder | 401/98 |
| 2,333,714 | 11/1943 | Fletcher | 401/50 |
| 2,366,928 | 1/1945 | Paschell | 401/51 |
| 2,398,521 | 4/1946 | Cloutier | 401/243 |
| 2,514,761 | 7/1950 | Havnen | 401/51 |
| 2,521,657 | 9/1950 | Severy | 401/243 |
| 2,557,638 | 8/1956 | Goldstein | 401/51 |
| 2,979,029 | 4/1961 | Melnikoff | 401/51 |
| 3,077,183 | 2/1963 | Spatz | 401/51 |
| 3,101,074 | 8/1963 | Spatz | 401/51 |
| 3,232,276 | 2/1966 | Kupersmith et al. | 401/51 |
| 3,768,915 | 10/1973 | Spatz | 401/50 |

FOREIGN PATENT DOCUMENTS

| | | | |
|---|---|---|---|
| 344989 | 12/1921 | Fed. Rep. of Germany | 401/51 |
| 929655 | 3/1956 | Fed. Rep. of Germany | 401/98 |
| 2359586 | 7/1976 | France | 401/51 |
| 195836 | 4/1923 | United Kingdom | 401/51 |
| 994071 | 6/1965 | United Kingdom | 401/51 |

*Primary Examiner*—William Pieprz

*Attorney, Agent, or Firm*—Sughrue, Rothwell, Mion, Zinn and Macpeak

[57] ABSTRACT

A pencil kit including a pencil comprising a coloring medium in substantially rod form and a sheath adapted to contain such coloring medium; a cap adapted removably to fit over an extremity of the pencil; and sharpening means included in the cap and adapted for paring away the sheath and sharpening an end of the coloring medium. Also a pencil cap adapted removably to fit over an extremity of a pencil, the cap including pencil sharpening means and retaining means adapted releasably to hold the cap on the pencil against axial withdrawal therefrom.

9 Claims, 3 Drawing Figures

PENCILS AND PENCIL CAPS

This invention relates to pencils, more particularly pencils of the kind suitable for use in cosmetic make-up, and pencil caps.

Eyebrow pencils are well known to the cosmetic industry. Such pencils generally comprise a "lead" of an eyebrow make-up medium, for instance mascara, which is soft and waxy. The pencil is generally provided with a cap to protect the lead point from breaking or soiling handbags and the like in which it is often carried loose.

It will be appreciated that as the lead point wears away during use, the pencil must be re-sharpened by paring away the wood sheath surrounding the pencil lead.

This often occasions difficulty as women seldom, if ever, carry a sharpening instrument, such as a sharp knife or blade, in their bags for this purpose or even keep such instrument with their cosmetics and make-up aids.

It is an object of the present invention to avoid or at least to minimize this disadvantage.

According to the invention there is provided a pencil kit including a pencil comprising a colouring medium in substantially rod form and a sheath adapted to contain such colouring medium; a cap adapted removably to fit over an extremity of the pencil; and sharpening means included in the cap and adapted for paring away the sheath and sharpening an end of the colouring medium.

The kit may include a waste material receptacle mountable on the cap.

The sheath may be manufactured from wood while the colouring medium may be chosen to be used in eyebrow or other cosmetic make-up. Thus the colouring medium may comprise mascara.

The sharpening means may comprise a blade which is adapted to be moved between an operative position in which a cutting edge thereof extends from the cap and an inoperative position in which the cutting edge of the blade is contained in the confines of the cap.

Preferably the sharpening means may be fixed in position on the cap. Thus, the sharpening means may comprise a blade which has a cutting edge that extends into the cap such that on rotation of the pencil in and relative to the cap, the sheath and colouring medium is suitably pared away.

The cap may be formed from a suitable metal in which case the blade may be formed from the wall of the cap.

Preferably, the cap is made from polymer material with a metal blade mounted thereon.

Preferably also, the blade is positioned such that the sharpened end of a pencil cannot extend beyond the blade extremity when the pencil is pushed home in the cap. This protects the sharpened end of the pencil against breakage and also prevents or minimizes soiling of adjacent articles by the sharpened end during storage of the pencil with the cap fitted on the pencil.

The cap may include retaining means adapted releasably to hold the cap against axial withdrawal therefrom but to allow relative rotation between the pencil and the cap when the latter is fitted over an extremity of the pencil.

The retaining means acts to hold the cap on the pencil during storage but permits relative rotation between the cap and the pencil for sharpening of the latter.

The retaining means may comprise a plurality of leaf-spring elements adapted to engage the periphery of the pencil.

The leaf-spring retaining elements may include radially inwardly extending engagement formations.

The cap may comprise a tubular body with a sharpening blade located towards one end of the tubular body and a plurality of leaf-spring retaining elements extending longitudinally from the opposite end of the tubular body.

The leaf-spring retaining elements are preferably integrally formed with a tubular body made of polymer material.

In a preferred embodiment, the cap comprises a tubular body of polymer material adapted to fit over the extremity of the pencil; a hollow conical tip integrally formed with the tubular body and extending lognitudinally from one end thereof; a sharpening blade mounted on the tip and lying at substantially the same angle relative to the axis of the tubular body as the wall of the conical tip; an outlet for waste material in the conical tip; and a plurality of retaining elements integrally formed with the tubular body and extending longitudinally from the opposite end thereof.

There may be provided a cover adapted to be mounted, preferably detachably, on the tubular body to define a waste material receptacle.

A cap according to the invention is preferably made to be disposable, the idea being that once a pencil with which it is associated has been used up, the cap and its sharpening means will have reached the end of its useful life.

The invention is particularly, but by no means exclusively, applicable to cosmetic make-up pencils. The invention is also applicable to graphite pencils, crayons and the like.

The invention includes within its scope not only a pencil kit as defined above, but also a cap as defined on its own, with or without a cover.

For a clear understanding of the invention a preferred embodiment will now be described by way of example with reference to the accompanying drawings in which.

The pencil kit comprises a cap A which includes a tubular body 1 of any suitable polymer material, such as high density polystyrene, which is adapted removably to fit over an end of pencil B. A hollow tip 2 is integrally formed with tubular body 1 from the same material as body 1 and extends longitudinally from one end of the tubular body 1. Tip 2 is provided with longitudinal slot 3 through its wall.

A metal sharpening blade 4 with a cutting edge 4*a*, is moulded into the material of body 1 and tip 2 during their production so that blade 4 is mounted on tip 2 in the zone of slot 3 to permit sharpening of pencil B when tubular body 1 is fitted over an extremity of pencil B. Blade 4 lies at substantially the same angle relative to the longitudinal axia of tubular body 1 as the wall of tip 2.

Figure 3:
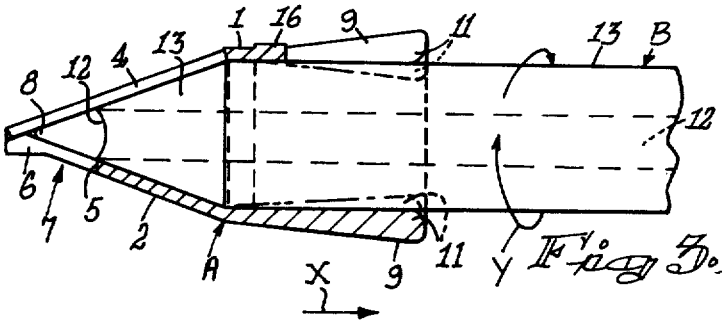
FIG. 3 is a longitudinal sectional view of the cap of FIGS. 1 and 2, without its cover but with its pencil in position.

In a zone 5 opposite to blade 4, the outer end of tip 2 is shorter than in zone 6 in which blade 4 is located, thereby to define an outlet 7 through which the sharpened point 8 of pencil B can extend as can best be seen in FIG. 3. Blade 4 is so positioned that the sharpened point 8 of pencil B cannot extend beyond the outer end of blade 4 when pencil B is pushed home in cap A.

Slot 3 and outlet 7 in the hollow tip 2 of cap A allows the discharge from tubular body 1 and/or from hollow tip 2 of waste material, such as parings or shavings from pencil B or a broken-off point 8 of pencil B.

A plurality of resilient, elongate retaining elements 9 are integrally formed with tubular body 1 from the same material as the body 1 and extend longitudinally from the end of hollow body 1 which is opposite to that at which sharpening blade 4 is located. Retaining elements 9 are in the nature of leaf springs which are arranged to define an annular configuration adapted to embrace pencil B, with longitudinal slots 10 separating adjacent retaining elements 9 from one another. Retaining elements 9 are adapted resiliently to engage the outer periphery of pencil B with a frictional grip so as releasably to hold cap A on pencil B against axial withdrawal therefrom and to allow relative rotation between cap A and pencil B to permit sharpening of pencil B.

To enhance the engagement between retaining elements 9 and pencil B, retaining elements 9 are provided towards their outer ends with integrally formed and radially inwardly directed engagement formations 11. As shown in dotted outline in FIGS. 2 and 3, the inner peripheries of engagement formations 11 are normally located radially inwardly of the inner periphery of tubular body 1 to define an entrance having a bore with a diameter less than the outer cross-sectional dimension of pencil B. When cap A is fitted over the end of pencil B, retaining elements 9 are resiliently displaced radially outwardly and grip pencil B firmly.

Pencil B comprises a colouring medium 12 in rod form and a wooden sheath 13 adapted to contain such colouring medium. The colouring medium may comprise a cosmetic make-up medium, such as mascara for eyebrow make-up, which has been compounded with a suitable carrier to constitute a rod-shaped colouring core 12 for the pencil.

Cap A is adapted to be pushed on to pencil B over an extremity thereof in the direction of arrow X, and to be releasably held in such position with a frictional engagement by means of retaining elements 9, as shown in FIG. 3. By relatively rotating cap A and pencil B as shown by arrow Y, the extremity of pencil B may be sharpened by means of blade 4. Shavings and other waste material can escape outwardly through slot 3 and outlet 7 in the tip 2 of the tubular body 1 of cap A.

In order to use the sharpened pencil B, cap A may be withdrawn axially therefrom in a direction opposite to arrow X. After use, cap A may be replaced on pencil B.

In order to prevent pencil B from penetrating too deep into cap A and the sharpened point 8 of core 12 of pencil B breaking off and jamming the tip 2 of cap A, blade 4 is so positioned that the point 8 of the pencil core 12 is sharpened to a point before such point projects beyond the outer end of blade 4. In the event of the point 8 of pencil core 12 breaking it can escape from tip 1 of cap A through outlet 7 in tip 1. This arrangement also protects the sharpened point 8 of pencil B during storage, such as in a handbag, pocket or the like.

It will be appreciated from the foregoing and seen from the accompanying drawings that longitudinally facing outlet 7 is located short of the outer end of blade 4 and extends around only part of the periphery of conical tip 2. The outlet 7 has a size relative to the cross-sectional dimensions of pencil B such that substantially the entire length of the sharpened point 8 of pencil core 12 can project through outlet 7 and be located adjacent the protruding portion 6 of tip 2 which extends longitudinally beyond outlet 7 around only part of the periphery of tip 2 and which supports blade 4 up to its outer end and cradles the sharpened point 8 of pencil core 12 around part of its periphery only.

It is the intention that a pencil B will be sold together with a disposable cap A so that when a pencil B is purchased, the buyer is provided in a convenient form with a sharpening device. The sharpening device and pencil remain together during the life of the pencil B and the sharpening device will be available when the pencil requires sharpening.

To ensure that cap A and pencil B remain together during the life of pencil B, cap A may be tied to pencil B by means of any suitable flexible cord, chain or other elongate element.

As a refinement, cap A may be provided with a cover C, which may be made of polymer material, such as high density polystyrene, or of metal, such as aluminium. Cover C is open at one end and closed at the opposite end. Cover C is adapted to be releasably mountable with a friction fit on cap A over its tip 2 and over blade 4. To provide a firm releasable engagement between cap A and cover C, cap A may be provided with integrally formed circumferentially spaced, radially outwardly extending protrusions 16 adapted to receive complementary, longitudinally extending notches 14 in the open end of cover C.

Figure 1:
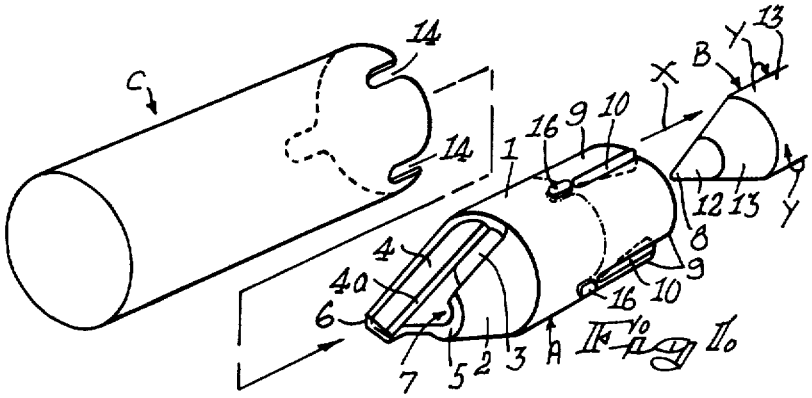
FIG. 1 is an exploded perspective view of a pencil kit according to the invention comprising a pencil; a cap with a sharpening blade; and a cover for the cap.
Figure 2:
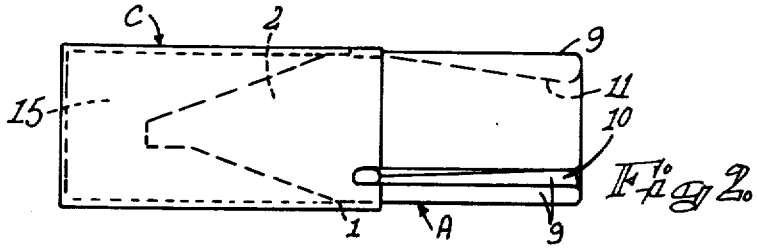
FIG. 2 is a side view of the cap of FIG. 1 with its cover in position but without the pencil.

Cover C defines a waste material receptacle 15 in its interior, as can best be seen from FIG. 2. Parings or shavings produced by sharpening of pencil B are retained in receptacle 15 which may be emptied, if required, by removing cover C from cap A.

It will be appreciated that many variations in detail are possible without departing from the scope of the appended claims. Thus, a suitable clip (not shown) may be provided on cap A or cover C so that the pencil may be retained in a pocket, if required.

I claim:

1. A cosmetic pencil kit including:

a cosmetic pencil comprising a core of waxy coloring medium in substantially rod form and a sheath containing the core;

and a cap comprising:

a tubular body adapted to removably fit directly over an extremity of the pencil;

a hollow tip on the body extending longitudinally from one end thereof;

a longitudinally extending sharpening blade on the tip, the blade lying obliquely to the longitudinal axis of the hollow body and being supported along its entire length;

said tip being provided with an outlet, said outlet having a first portion (3) extending longitudinally along the blade, and having a second portion (7) in a plane perpendicular to said longitudinal axis and located short of the outer end of the blade and extending around only part of the periphery of the tip, the tip presenting a protruding portion which extends longitudinally beyond the second portion of said outlet around only part of the periphery of the tip and which supports the blade up to its outer end, the blade being operative to pare away the pencil sheath to expose and sharpen an end of the core on relative rotation of the pencil and the cap when the tubular body is fitted over an extremity of the pencil, the second portion of said outlet having a size relative to the cross-sectional dimensions of the pencil and being located relative to the blade such that substantially the entire length of the sharpened end of the pencil core can project through the second portion of said outlet in the tip, and be located adjacent to, and supported along its length by the said protruding portion of the tip, but such that the sharpened end of the core cannot extend beyond the outer end of the blade or said protruding portion of the tip when the pencil is pushed home in the cap.

2. A pencil kit as claimed in claim 1, including a waste material receptacle mountable on the cap over the tip and blade.

3. A pencil kit as claimed in claim 1 or claim 2, wherein the cap is disposable, the tubular body and tip on the body being made of polymer material and the blade being made of metal.

4. A cosmetic pencil kit including:

a cosmetic pencil comprising a core of waxy coloring medium in substantially rod form and a sheath containing the core; and a cap comprising:

a tubular body adapted to removably fit directly over an extremity of the pencil;

a hollow tip on the body extending longitudinally from one end thereof;

a longitudinally extending sharpening blade on the tip the blade lying obliquely to the longitudinal axis of the hollow body and being supported along its entire length;

said tip being provided with an outlet, said outlet having a first portion (3) extending longitudinally along the blade, and having a second portion (7) in a plane perpendicular to said longitudinal axis and located short of the outer end of the blade and extending around only part of the periphery of the tip, the tip presenting a protruding portion which extends longitudinally beyond the second portion of said outlet around only part of the periphery of the tip and which supports the blade up to its outer end, the blade being operative to pare away the pencil sheath to expose and sharpen an end of the core on relative rotation of the pencil and the cap when the tubular body is fitted over an extremity of the pencil, the second portion of said outlet having a size relative to the cross-sectional dimensions of the pencil and being located relative to the blade such that substantially the entire length of the sharpened end of the pencil core can project through the second portion of said outlet in the tip, and be located adjacent to, and supported along its length by said protruding portion of the tip, but such that the sharpened end of the core cannot extend beyond the outer end of the blade or said protruding portion of the tip when the pencil is pushed home in the cap;

and retaining means fast with tubular body towards its end opposite the tip, the retaining means being adapted frictionally to grip the sheath of the pencil and releasably to hold the cap on the pencil against axial withdrawal therefrom but to allow relative rotation between the pencil and the cap for sharpening of the pencil.

5. A cosmetic pencil kit as claimed in claim 4, wherein the retaining means comprises a plurality of leaf-spring retaining elements extending longitudinally away from the end of the tubular body opposite to the tip; and engagement formations which extend radially inwardly from the leaf-spring elements and are adapted resiliently to engage the periphery of the sheath of the pencil with a frictional grip.

6. A disposable cosmetic pencil cap comprising:

a tubular body adapted to removably fit directly over an extremity of a cosmetic pencil comprising a core of waxy coloring medium contained in an outer sheath;

a hollow conical tip integral with the body and extending longitudinally from one end thereof;

a longitudinally extending sharpening blade on the tip, the blade lying obliquely to the longitudinal axis of the hollow body and being supported along its entire length;

said tip being provided with an outlet, said outlet having a first portion (3) extending longitudinally along the blade, and having a second portion (7) in a plane perpendicular to said longitudinal axis and located short of the outer end of the blade and extending around only part of the periphery of the tip, the tip presenting a protruding portion which extends longitudinally beyond the second portion of said outlet around only part of the periphery of the tip and which supports the blade up to its outer end, the blade being operative to pare away the pencil sheath to expose and sharpen an end of the core on relative rotation of the pencil and the cap when the tubular body is fitted over an extremity of the pencil, the second portion of said outlet having a size and being located relative to the blade such that the sharpened end of the pencil core can project substantially along its entire length through the second portion of said outlet in the tip and can be supported and cradled around only part of its periphery by said protruding portion of the tip, but such that the sharpened end of the core cannot extend beyond the outer end of the blade or the protruding portion of the tip when the pencil is pushed home in the cap;

and retaining means fast with the tubular body at its end opposite to the tip, the retaining means comprising:

a plurality of leaf-spring elements integral with and extending longitudinally away from the end of the tubular body opposite to the tip;

and engagement formations integral with and extending radially inwardly from the leaf-spring elements, the engagement formations being adapted frictionally to engage the periphery of the sheath of the pencil and releasably to hold the cap on the pencil against axial withdrawal therefrom but to allow relative rotation between the pencil and the cap for sharpening of the pencil.

7. A pencil cap as claimed in claim 6, including a cover adapted to be mounted on the tubular body over the conical tip and the sharpening blade and define a waste material receptacle.

8. A cosmetic pencil kit including:

a cosmetic pencil comprising a core of waxy coloring medium in substantially rod form and a sheath containing the core; and a disposable cap comprising:

a tubular body adapted to removably fit directly over an extremity of the pencil;

a hollow tip on the body extending longitudinally from one end thereof;

a longitudinally extending sharpening blade on the tip, the blade lying obliquely to the longitudinal axis of the hollow body and being supported along its entire length;

said tip being provided with an outlet, said outlet having a first portion (3) extending longitudinally along the blade, and having a second portion (7) in a plane perpendicular to said longitudinal axis and located short of the outer end of the blade and extending around only part of the periphery of the tip such that the tip presents a protruding portion which extends longitudinally beyond the second portion of said outlet around only part of the periphery of the tip and which supports the blade up to its outer end, the sharpened end of the pencil core projecting through the second portion of said outlet in the tip, said sharpened end being supported against breakage by said protruding portion of said tip, said protruding portion being of a shape conforming to the shape of said sharpened end, whereby said sharpened end is held between said protruding portion and a portion of said blade, and retaining means fast with the tubular body at the end opposite to the tip, the retaining means comprising:

a plurality of elongate leaf-spring retaining elements which extend longitudinally in annular configuration away from the end of the tubular body opposite to the tip;

and an engagement formation which extends radially inwardly from each leaf-spring element, the inner peripheries of the engagement formation normally being located radially inwardly of the inner periphery of the tubular body to define an entrance into the body having a bore with a diameter less than the outer cross-sectional dimension of the pencil, the leaf-spring retaining elements being resiliently displaceable radially outwardly to permit the engagement formations releasably to engage the outer periphery of the pencil with a frictional grip to allow relative rotation between the cap and the pencil for sharpening of the latter.

9. A disposable cosmetic pencil cap comprising:

a tubular body adapted to removably fit directly over an extremity of a cosmetic pencil comprising a core of waxy coloring medium contained in an outer sheath;

a hollow conical tip integral with the body and extending longitudinally from one end thereof;

a longitudinally extending sharpening blade on the tip, the blade lying obliquely to the longitudinal axis of the hollow body and being supported along its entire length;

said tip being provided with an outlet, said outlet having a first portion (3) extending longitudinally along the blade, and having a second portion (7) in a plane perpendicular to said longitudinal axis and located short of the outer end of the blade and extending around only part of the periphery of the tip, the tip presenting a protruding portion which extends longitudinally beyond the second portion of said outlet around only part of the periphery of the tip and which supports the blade up to its outer end, the blade being operative to pare away the pencil sheath to expose and sharpen an end of the core on relative rotation of the pencil and the cap when the tubular body is fitted over an extremity of the pencil, the second portion of said outlet having a size and being located relative to the blade such that the sharpened end of the pencil core can project substantially along its entire length through the second portion of said outlet in the tip and can be supported and cradled around only part of its periphery by said protruding portion of the tip, but such that the sharpened end of the core cannot extend beyond the outer end of the blade or the protruding portion of the tip when the pencil is pushed home in the cap;

and retaining means fast with the tubular body at its end opposite to the tip, the retaining means comprising;

a plurality of leaf-spring elements integral with and extending longitudinally away from the end of the tubular body opposite to the tip;

and engagement formations integral with and extending radially inwardly from the leaf-spring elements, the engagement formations being adapted to frictionally engage the periphery of the sheath of the pencil and to releasably hold the cap on the pencil against axial withdrawal therefrom, but to allow relative rotation between the pencil and the cap for sharpening the pencil;

and a cover adapted to be mounted on the tubular body over the sharpening blade thereof, said cover being open at one end and closed at the opposte end thereby defining a waste material receptacle, said cover being adapted to be releasably mountable and frictionally engaged with the cap, said cap being further provided with integrally formed circumferentially spaced radially outwardly extending protrusions, said protrusions being adapted to be received within complementary longitudinally extending notches formed at the open end of said cover.

* * * * *